United States Patent [19]

Muller

[11] 4,241,690

[45] Dec. 30, 1980

[54] APPARATUS FOR COATING MOVING WEBS

[75] Inventor: Peter Muller, Port Washington, N.Y.

[73] Assignee: Andrews Paper & Chemical Co., Inc., Port Washington, N.Y.

[21] Appl. No.: 27,164

[22] Filed: Apr. 4, 1979

[51] Int. Cl.[3] ..... B05C 1/08; B05C 11/06

[52] U.S. Cl. ..... 118/63; 118/244

[58] Field of Search ..... 118/63, 244, 602, 612, 118/258, 694; 427/348, 345

[56] References Cited

U.S. PATENT DOCUMENTS

| | | | |
|---|---|---|---|
| 2,241,104 | 5/1941 | Van Der Grinten | 118/258 X |
| 2,284,641 | 6/1942 | Cox, Jr. et al. | 118/258 X |
| 3,025,828 | 3/1962 | Heilman | 118/63 |
| 3,045,315 | 7/1962 | Dusenbury | 118/602 X |
| 3,492,840 | 2/1970 | Korsch | 118/258 X |

FOREIGN PATENT DOCUMENTS

| | | | |
|---|---|---|---|
| 807805 | 1/1959 | United Kingdom | 118/63 |

*Primary Examiner*—John P. McIntosh

*Attorney, Agent, or Firm*—Kane, Dalsimer, Kane, Sullivan and Kurucz

[57] ABSTRACT

Apparatus for coating and metering a coating on a paper web. A system is provided for mixing doctored excess coating material with fresh, make-up material and recirculating the mix by gravity flow for reapplication to the moving paper web.

3 Claims, 2 Drawing Figures

APPARATUS FOR COATING MOVING WEBS

BACKGROUND OF THE INVENTION

1. Field of the Invention

The invention relates to apparatus for coating moving webs and more particularly relates to such apparatus including improved means for recirculating excesses of coatings, initially applied to the web.

2. Brief Description of the Prior Art

The prior art is replete with descriptions of apparatus for the continuous coating of moving webs such as continuous lengths of paper sheet materials. In one type of apparatus, the coating liquid is brought to the moving web by an applicator roller which is partially immersed in a reservoir of the coating liquid. Excesses of the applied coating are doctored off the web with a mechanical scraper or an airknife. The doctored excess is directed back into the applicator reservoir where it mixes with fresh or make-up coating liquid. This arrangement was not satisfactory for all purposes, since the applied coating composition generally undergoes compositional changes while in contact with the web. The doctored excess returned to the coating application reservoir may have a different compositional make-up than the unapplied coating materials. It wil be appreciated that incomplete mixing of the two, essentially different coating materials, generally results in coating marks becoming highly visible on the coated web due to the heterogenicity of the actually applied coating compositions.

In order to solve the aforementioned problem in the prior art, it has been proposed to add pumps to circulate and recirculate the liquids, between the coating reservoir and a separate collection vessel adapted to receive the doctored excess coating. This improves mixing and homogenicity of the coating composition being applied and retained on the web. However, the introduction of pumps is not an entirely satisfactory solution to the prior art problems. Not only does the addition of a pump recirculating system represent a significant capital investment, but pumps tend to generate foams in some coating liquids. Pumps tend to introduce air into the coating liquids, through defective gaskets or from too rapid linear flow speeds.

The present invention is an improvement over the prior art apparatus in that efficient mixing and recirculation of the doctored excesses of coating liquids is achieved without the use or need for external pumps. Instead, by repositioning of certain apparatus components an "innate pumping" system is obtained, which does not generate foams. Energy is conserved employing the improved apparatus of the invention and a high level of coating quality on the finished web is achieved.

SUMMARY OF THE INVENTION

The invention comprises in an apparatus for coating a continuous, moving web with a liquid, said apparatus comprising;

means for passing the web from a first position to a second position;

a reservoir adapted to contain a liquid coating composition;

means associated with said reservoir, positioned between the first and second positions, for applying the liquid coating composition from the reservoir to the passing web;

means of doctoring excess composition applied to the web positioned after the means for applying;

a collector vessel positioned beneath the means of doctoring and adapted to collect excess composition doctored from the passing web;

a mixing vessel adapted to receive and mix liquid compositions;

first conduit means connecting the collector vessel with the mixing vessel and providing liquid communication between said vessels;

means for introducing make-up liquid composition into the mixing vessel; and second conduit means between the mixing vessel and the reservoir, providing liquid communication between the mixing vessel and said revervoir;

the improvement wherein;

the collector vessel is mounted at an elevation and position relative to the elevation and position of the mixing vessel, whereby doctored excess composition collected in the collector vessel will flow under the force of gravity through the first conduit means to the mixing vessel; and said mixing vessel is mounted at an elevation and position relative to the reservoir, whereby liquid composition in the mixing vessel will flow under the force of gravity to the reservoir through the second conduit means.

In operation, the absence of pumps to recirculate the doctored excess of liquid compositions eliminates foaming and improves the coating quality. The relatively low linear coating velocities also reduce electrostatic charge build-up in the apparatus of the invention.

DETAILED DESCRIPTION OF THE PREFERRED EMBODIMENTS OF THE INVENTION

Figure 1:
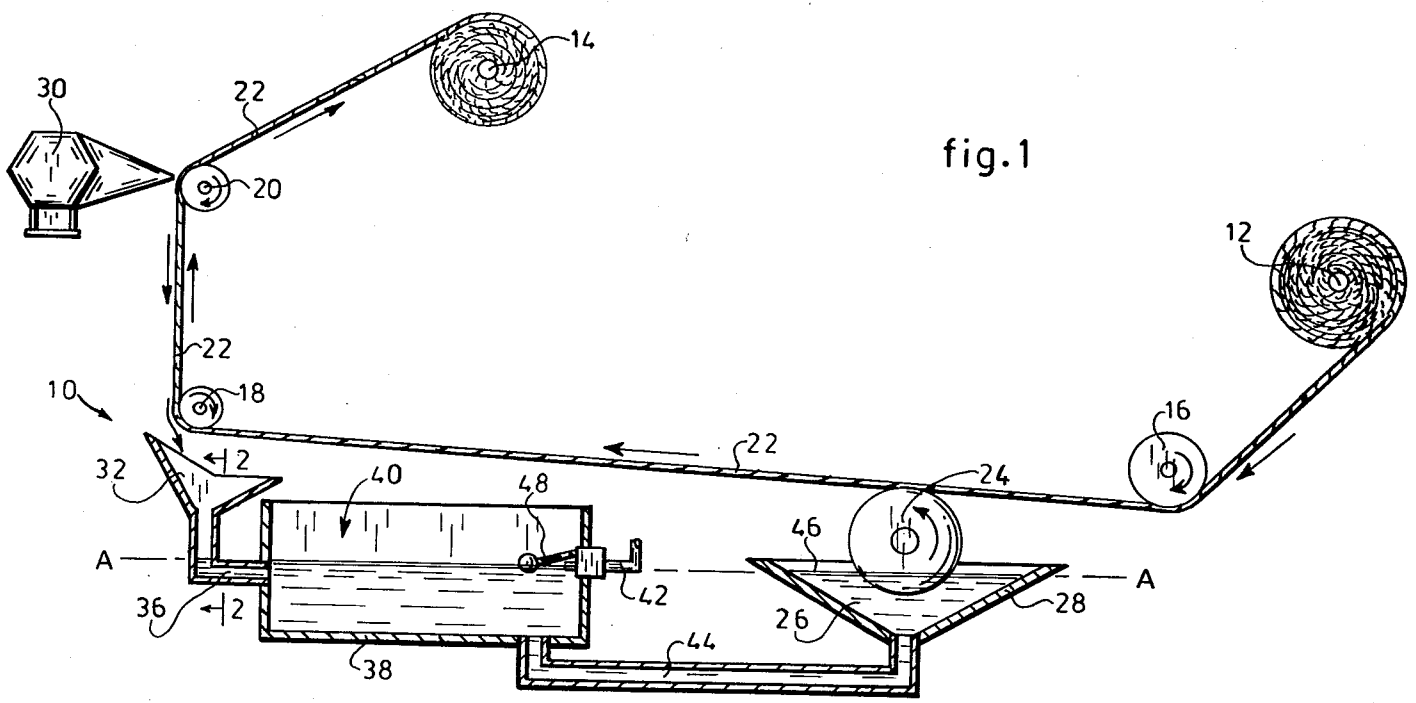
FIG. 1 is a cross-sectional, side elevation of an embodiment apparatus of the invention.
Figure 2:
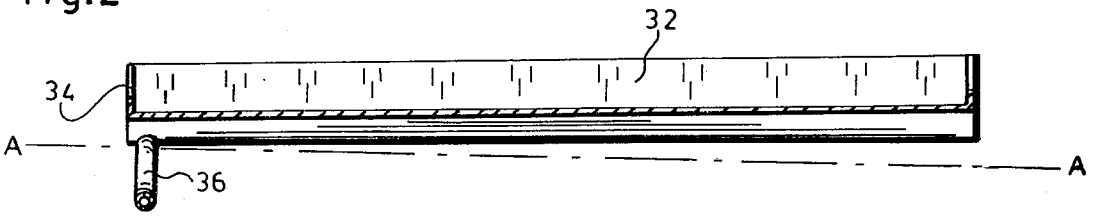
FIG. 2 is a view along lines 2—2 of FIG. 1.

A complete understanding of the improved apparatus of the invention may be obtained from a reading of the following description in conjunction with FIGS. 1 and 2 of the accompanying drawings.

Referring first to FIG. 1, one may see a cross-sectional, side elevation of an embodiment apparatus of the invention. The apparatus 10 comprises a supply roller 12 and a take up roller 14 which together with guide rollers 16, 18 and 20 comprise a means for passing a web 22 continuously from a first position (roller 12) to a second position (roller 14). The continuously travelling web 22 moves from roller 12 to roller 14 at any desired and practical speed. The web 22 may be of any material desired for coating. Generally, the apparatus 10 is advantageously employed to apply a liquid coating composition to continuously moving webs 22 of paper.

During its passage from supply roller 12 to take-up roller 14, motivated by a power means (not shown in FIG. 1), the web 22 is brought in contact with an applicator roller 24. Applicator roller 24 is partially immersed in a liquid coating composition 26 contained in a reservoir 28 adapted for such containment. The liquid coating composition 26 held in reservoir 28 is picked up by rotation of the applicator roller 24 and carried to a surface of the moving web 22. As the web 22 in its passage toward take up roller 14 passes guide roller 20, an airknife 30 functions as a means for doctoring excess composition 26 applied to the web 22 from the web 22. Any other mechanical means of doctoring may be employed.

It should be noted that in the preferred embodiment apparatus 10 of the invention, the web 22 moves in a substantially horizontal plane until it reaches the guide roller 18. At this point, the web 22 is carried in a substantially vertical direction, upward toward the guide roller 20. Positioned beneath the web 22 during its passage between guide rollers 18 and 20, is a collection vessel 32 positioned and adapted by its construction to receive the excess of composition 26 doctored from the web 22 by airknife 30. It will be appreciated that the web 22 can be of a substantial width and the doctoring airknife 30 is constructed and adapted to match that width. Similarly, the collection vessel 32 is of a width sufficient to collect all of the excess composition 26 doctored from the web 22. Referring briefly to FIG. 2, a view along lines 2—2 of FIG. 1, one can see a width profile of the collector vessel 32. It should also be noted from the FIG. 2 that the collection device 32 is tilted from a level plane along lines A—A so that collected composition 26 doctored from web 22 will flow towards one end 34 of collection vessel 32. The lower end 34 of collection vessel 32 communicates through a pipe 36 or like conduit means with a mixing vessel 38 (refer back to FIG. 1 again). It will be observed that the mixing vessel 38 is positioned at a lower elevation than the conduit pipe 36 and collection vessel 32. Thus, doctored excess composition 26 will flow under the force of gravity to the end 34 of collection vessel 32, through the open conduit 36 and into the mixing vessel 38. The mixing vessel 38 is open at its top end 40 and receives through pipe 42 additional, fresh, make-up composition 26 from a reservoir source (not shown in FIG. 1) for composition 26. Entry of the doctored excess composition 26 and fresh make-up composition 26 through pipe 42 into the mixing vessel 38 generally creates sufficient force for admixture of the composition 26 from these two sources. If desired, additional stirring means could be provided to ensure a homogeneous mixture of the doctored excess directed into mixing vessel 38 with fresh make-up composition 26 received from the conduit 42. The mixing vessel 38 is located at an elevation and position whereby mixed composition 26 may flow under the force of gravity into the reservoir 28 through pipe 44 as a conduit means providing fluid communication between mixing vessel 38 and reservoir 28. In this manner, a level 46 within reservoir 28 is maintained so that the applicator roller 24 may continuously pick up the liquid coating composition 26 for application to the passing web 22. The level of liquid coating composition 26 in both mixing vessel 38 and reservoir 28 may be maintained at a desired level by control with float valve 48 which permits inflow of make-up composition 26 as necessary through the pipe 42.

Thus, in operation, the recirculation of excess coating composition applied to web 22 is admixed with fresh make-up composition and carried back to the coating reservoir, all under the influence of gravity. This eliminates the need for any pumps in the recirculation system employed in the improved apparatus of the invention. The economic savings are obvious.

What is claimed:

1. In apparatus for coating a continuous, moving paper web with a liquid, said apparatus comprising;

means for passing the paper web from a first position to a second position;

a reservoir adapted to contain a liquid coating composition;

means associated with said reservoir, positioned between the first and second positions, for applying the liquid coating composition from the reservoir to the passing paper web;

means for doctoring excess composition applied to the paper web, positioned after the means for applying;

a collector vessel positioned beneath the means of doctoring and adapted to collect excess composition doctored from the passing paper web;

a mixing vessel adapted to receive and mix liquid compositions;

first conduit means connecting the collector vessel with the mixing vessel and providing liquid communication between said vessels;

means for introducting make-up liquid composition into the mixing vessel; and second conduit means between the mixing vessel and the reservoir, providing liquid communication between the mixing vessel and said reservoir;

the improvement wherein;

the collector vessel is mounted at an elevation and position relative to the elevation and position of the mixing vessel, whereby doctored excess composition collected in the collector vessel will flow under the force of gravity through the first conduit means to the mixing vessel; and said mixing vessel is mounted at an elevation and position relative to the reservoir, whereby liquid composition in the mixing vessel will flow under the force of gravity to the reservoir through the second conduit means.

2. The improved apparatus of claim 1 wherein the elevation of the mixing vessel in relation to the elevation of the reservoir is such that a predetermined level of a liquid in the reservoir may be maintained under the force of gravity as applied to both of said reservoir and said mixing vessel.

3. The apparatus of claim 1 wherein valve means is associated with the means for introducing make-up liquid composition, whereby said make-up liquid composition is introduced into the mixing vessel as needed.

* * * * *